US006383628B2

(12) United States Patent
Abe et al.

(10) Patent No.: US 6,383,628 B2
(45) **Date of Patent: *May 7, 2002**

(54) IMAGE HEATING DEVICE

(75) Inventors: Atsuyoshi Abe; Toru Saitou, both of Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/005,192

(22) Filed: Jan. 9, 1998

Related U.S. Application Data

(62) Division of application No. 08/848,724, filed on May 19, 1997, now Pat. No. 5,745,833, which is a continuation of application No. 08/600,518, filed on Feb. 13, 1996, now abandoned.

(30) Foreign Application Priority Data

Feb. 15, 1995 (JP) ..... 7-16746
Feb. 7, 1996 (JP) ..... 8-21152

(51) Int. Cl.[7] ..... G03G 15/20; B21B 27/06

(52) U.S. Cl. ..... 428/334; 426/465; 219/469; 219/619; 399/330

(58) Field of Search ..... 428/334, 465; 399/330; 219/619, 469

(56) References Cited

U.S. PATENT DOCUMENTS

| | | | | |
|---|---|---|---|---|
| 4,570,044 A | | 2/1986 | Kobayashi et al. | |
| 4,912,514 A | | 3/1990 | Mizutani | |
| 5,074,019 A | | 12/1991 | Link | |
| 5,253,027 A | | 10/1993 | Goto | 355/290 |
| 5,303,016 A | | 4/1994 | Oda et al. | |
| 5,319,427 A | | 6/1994 | Sakurai et al. | 355/285 |
| 5,327,202 A | | 7/1994 | Nami et al. | 355/282 |
| 5,420,679 A | | 5/1995 | Goto et al. | |
| 5,422,707 A | * | 6/1995 | Takiguchi et al. | 355/245 |
| 5,464,698 A | | 11/1995 | Chen et al. | 428/421 |
| 5,471,288 A | | 11/1995 | Ohtsuka et al. | 355/285 |
| 5,510,223 A | * | 4/1996 | Kukimoto et al. | 430/126 |
| 5,526,103 A | | 6/1996 | Kato et al. | |

(List continued on next page.)

FOREIGN PATENT DOCUMENTS

| | | |
|---|---|---|
| JP | 57-128372 | 8/1982 |
| JP | 61-261763 | 11/1986 |
| JP | 62-150371 | 7/1987 |
| JP | 1-144084 | 6/1989 |
| JP | 5-9027 | 2/1993 |
| JP | 08-16005 | 1/1996 |
| JP | 08-137306 | 5/1996 |

*Primary Examiner*—Hoa T. Le
(74) *Attorney, Agent, or Firm*—Fitzpatrick, Cella, Harper & Scinto

(57) ABSTRACT

There is disclosed an image heating device, provided with a movable member including an electroconductive layer and adapted to move with a recording member, a magnetizing coil for generating a magnetic flux, provided continuously over the entire width of the movable member in a direction perpendicular to the moving direction of the movable member, and a core member for guiding the magnetic flux. The magnetic flux generated by the magnetizing coil induces an eddy current in the movable member, thereby heating an image supported on the recording member by the heat generated in the movable member by the eddy current. At least a part of the magnetizing coil is provided along the movable member not along the core member.

15 Claims, 6 Drawing Sheets

U.S. PATENT DOCUMENTS 5,534,987 A 7/1996 Ohtsuka et al. ..... 355/285
5,547,759 A 8/1996 Chen et al. ..... 428/421
5,552,582 A 9/1996 Abe et al.
5,568,240 A 10/1996 Ohtsuka
5,571,766 A * 11/1996 Imai et al. ..... 503/227
5,635,325 A * 6/1997 Inaba et al. ..... 430/106
5,659,857 A * 8/1997 Yamazaki et al. ..... 399/252
5,666,627 A 9/1997 Yamaguchi
5,745,833 A * 4/1998 Abe et al. ..... 399/330
5,819,150 A 10/1998 Hayasaki et al. ..... 399/330

* cited by examiner

IMAGE HEATING DEVICE

This application is a divisional application of Ser. No. 08/848,724, U.S. Pat. No. 5,745,833 filed May 19, 1997, which is a continuation application of Ser. No. 08/600,518, abandoned filed Feb. 13, 1996.

BACKGROUND OF THE INVENTION

1. Field of the Invention

The present invention relates to an image heating device, effecting heating with an eddy current generated by electromagnetic induction, and more particularly to an image heating device for fixing an unfixed image in an image forming apparatus such as an electrophotographic apparatus or an electrostatic recording apparatus.

2. Related Background Art

In the image heating device represented by a thermal fixing device, there has widely been used the contact heating method, such as utilizing a heat roller. In particular, for fixing a color image having four toner layers at maximum, the toner image is heated by a halogen heater through a metal core and an elastic rubber layer of the fixing roller.

On the other hand, the Japanese Patent Publication No. 5-9027 proposes to utilize Joule heat generated by an eddy current induced in the fixing roller by a magnetic flux.

Utilization of such eddy current allows to bring the position of heat generation closer to the toner image, thereby leading to an improved efficiency of the energy consumption, in comparison with that of the heat roller utilizing the halogen lamp.

However, in the device disclosed in the Japanese Patent Publication No. 5-9027, though the magnetizing core is positioned relatively close to the cylindrical member, the magnetizing coil which generates the magnetic flux is still distant from the cylindrical member, so that the heat efficiency is not so high.

SUMMARY OF THE INVENTION

An object of the present invention is to provide an image heating device capable of improving the heat efficiency in heat generation in a movable member by a magnetizing coil.

Another object of the present invention is to provide an image heating device in which a magnetizing coil provided continuously over the entire width of the movable member, is provided along the movable member without at least partially along a core material.

Still another object of the present invention is to provide an image heating device in which a magnetizing coil provided continuously over the entire width of the movable member, is provided so that a substantially entire portion of an upstream side of the nip of the magnetizing coil is along the movable member.

Still other objects of the present invention, and the features thereof, will become fully apparent from the following description.

DETAILED DESCRIPTION OF THE PREFERRED EMBODIMENTS

Now the present invention will be clarified in detail by preferred embodiments thereof, with reference to the attached drawings.

[First Embodiment]

Figure 10:
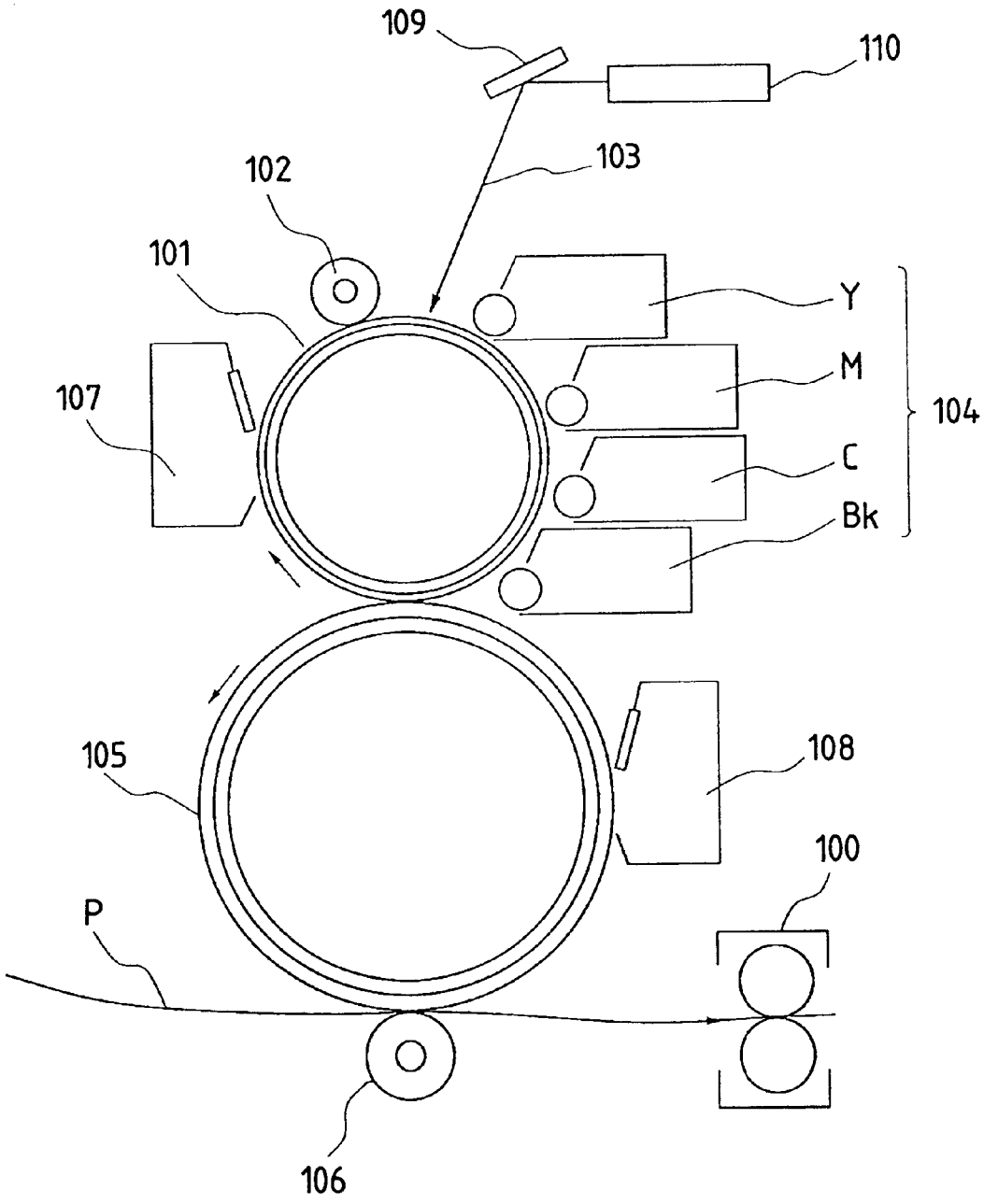
FIG. 10 is a cross-sectional view of an image forming apparatus in which an embodiment of the present invention is applied.

FIG. 10 is a cross-sectional view of an electrophotographic color printer employing an image heating device constituting an embodiment of the present invention. There are shown a photosensitive drum 101 composed of an organic photosensitive member or an amorphous silicon photosensitive member, a charging roller 102 for uniformly charging the above-mentioned photosensitive drum 101, a laser optical unit 110 for on/off control of a laser beam according to a signal from an image signal generator (not shown) thereof to form an electrostatic latent image on the photosensitive drum 101, a laser beam 103 and a mirror 109. The electrostatic latent image on the photosensitive drum 101 is rendered visible by selective deposition of toner by a developing unit 104. The developing unit 104 is composed of color developing units Y, M, C respectively for yellow, magenta and cyan colors, and a black developing unit B, which respectively develop the latent images per one color on the photosensitive drum 101. Thus obtained toner images are overlaid in succession on an intermediate transfer drum 105 to obtain a color image. The intermediate transfer drum 105 is provided on a metal drum with an elastic layer of a medium resistance and a surface layer of a high resistance. The toner image is transferred by a potential difference from the photosensitive drum 101, generated by a bias potential given to the metal drum. On the other hand, a recording member P fed by a feed roller from a sheet cassette is supplied to the nip between a transfer roller 106 and the intermediate transfer drum 105 in synchronization with the electrostatic latent image on the photosensitive drum 101. The transfer roller 106 provides the rear face of a recording member P with a charge of a polarity opposite to that of the toner, thereby transferring the toner image from the intermediate transfer drum 105 onto the recording member P. The recording member bearing unfixed toner images thereon is then subjected to the application of heat and pressure in a heat fixing device 100 constituting an image heating device, whereby the toner images are permanently fixed on the recording member, which is then discharged onto a discharging tray (not shown). The toner and paper powder remaining on the photosensitive drum 101 are eliminated by a cleaner 107 while those remaining on the intermediate transfer drum 105 are eliminated by a cleaner 108, and the photosensitive drum is used repeatedly in the steps from the charging.

In the following there will be explained the image heating device of the present embodiment.

(1) Structure of the image heating device (FIG.

Figure 1:
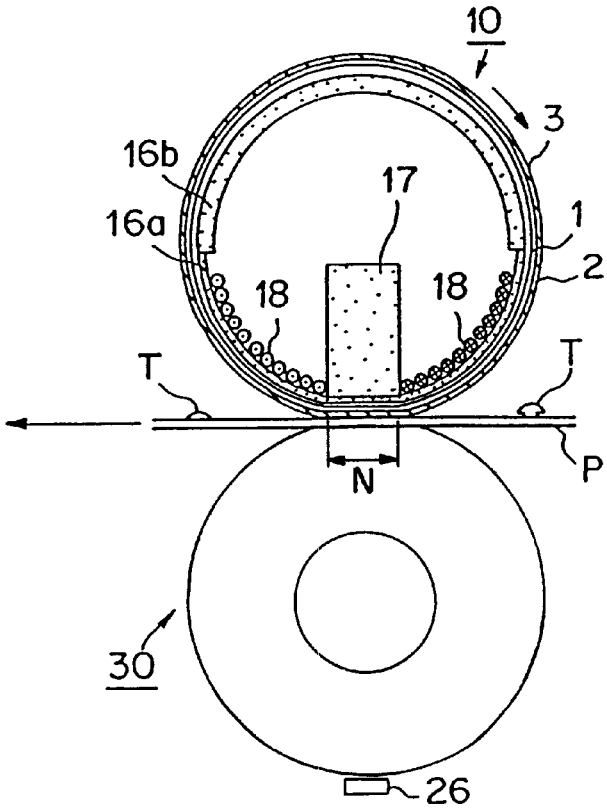
FIG. 1 is a cross-sectional view of an image heating device embodying the present invention.

FIG. 1 is a cross-sectional view of the fixing device in the present embodiment.

A fixing film 10 as a rotary movable member, is rotated in a direction indicated by an arrow, wherein pressurization to the nip portion and transporting stability of the fixing film are achieved by film guides 16*a*, 16*b*.

The film guide 16*a* also serves to support a core 17 of a high magnetic permeability for guiding the magnetic flux and a magnetizing coil 18 for generating the magnetic flux. The core 17 of the high magnetic permeability is preferably composed of a material such as ferrite or permalloy employed in the core of the transformer, more preferably ferrite having low loss property even at 100 kHz or higher.

The coil 18 is connected to a magnetizing circuit (FIG. 2), which can generate a high frequency from 20 to 500 kHz by a switching power source. Fixation by heat is achieved by passing the recording member P bearing unfixed toner T thereon, through a nip N formed by the fixing film 10 and a pressure roller 30 constituting a pressure member.

The principle of heating in the nip is as shown in FIG. 1. Magnetic flux generated by the current supplied from the magnetizing circuit (FIG. 2) to the coil 18 is guided by the high-permeability core 17 to induce an eddy current in a heat generating layer 1 of the fixing film 10, and heat is generated by this eddy current and the specific resistance of the heat generating layer 1.

The recording member P and the toner T thereon transported to the nip N are heated by the generated heat through an elastic layer 2 and a releasing layer 3, thereby fusing the toner T in the nip N. The toner T is cooled after having passed the nip N, thereby making a permanently fixed image.

Figure 2:
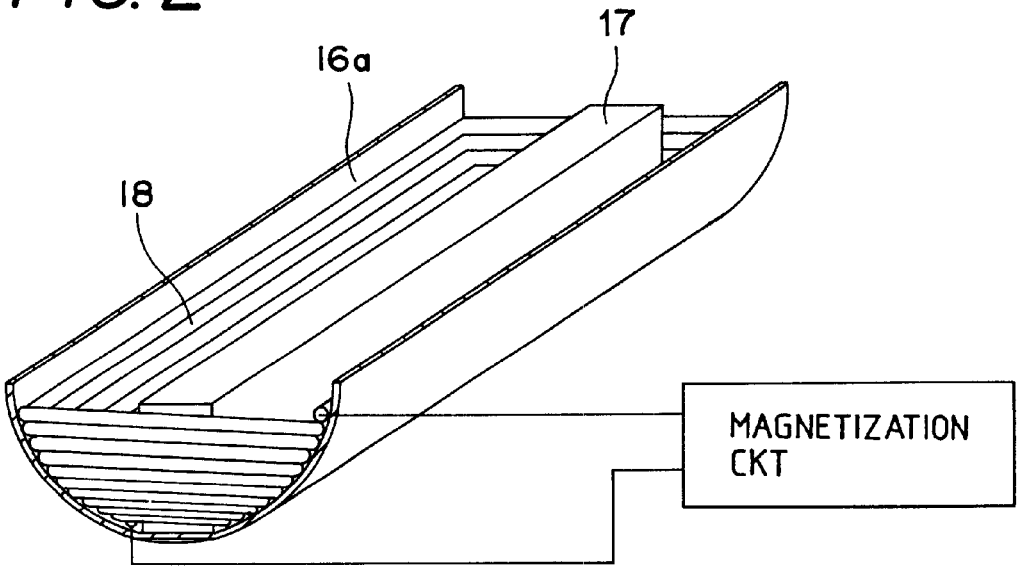
FIG. 2 is a perspective view of a magnetizing coil, a core and a stay of a first embodiment.

(2) Shape of magnetizing coil and core;

As shown in FIG. 2, the magnetization coil 18 is provided continuously over the entire width perpendicular to the moving direction of the fixing film 10.

To efficiently absorb the magnetic field generated by the magnetizing coil 18 into the heat generating layer 1 of the fixing film 10, a distance between the magnetizing coil 18 and the heat generating layer 1 of the fixing film 10 is preferably as small as possible.

For this reason, the magnetizing coil 18 is arranged along the curved surface of the heat generating layer 1 in FIG. 1 so that an area where the distance of the magnetizing coil 18 is small, may increase. Stated differently, at least a part of the magnetizing coil 18 is provided along the fixing film 10, not along the core 17. More specifically, in the present embodiment, the magnetizing coil 18 is provided along the film guide 16*a* with arcuate shape, and the fixing film 10 moves along the film guide 16*a*, so that the magnetizing coil 18 is positioned along the fixing film 10. The distance between the heat generating layer 1 and the magnetizing coil 18 is selected as about 1 mm.

By such arrangement of the magnetizing coil 18, an area where the magnetizing coil 18 and the heat generating layer 1 are close to face each other, is increased, thereby significantly improving the heat efficiency. Also, at least a part of the magnetizing coil is not provided along the core closely thereto, so that it is rendered possible to suppress the temperature rise in the core and to prevent unstable variation of the magnetic flux.

The distance between the core 17 or the magnetizing coil 18 and the heat generating layer is preferably as small as possible in view of achieving a higher absorbing efficiency for the magnetic flux. The distance is selected in practice as 5 mm or less, since the absorbing efficiency is deteriorated if the above-mentioned distance exceeds 5 mm. On the other hand, if within the limit of 5 mm, the distance between the heat generating layer 1 and the magnetizing coil 18 need not be constant.

Figure 3:
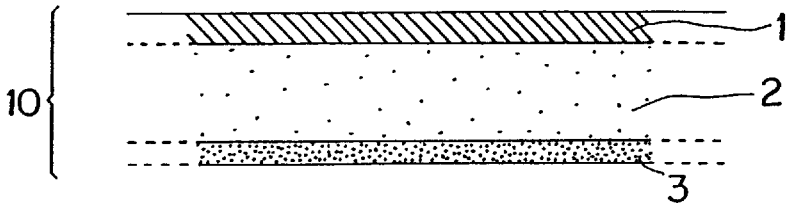
FIG. 3 is a partial cross-sectional view of a fixing film in the first embodiment.

(3) Structure of the fixing film (FIG. 3):

The heat generating layer 1, consisting of an electrically conductive layer composed for example of a metal film constituting the substrate of the fixing film, is preferably composed of a ferromagnetic metal such as nickel, iron, ferromagnetic stainless steel or nickel-cobalt alloy.

The heat generating layer 1 of the fixing film 10 can also be composed of a non-magnetic metal, but is preferably composed of a metal with satisfactory magnetic flux absorption, such as nickel, iron, magnetic stainless steel or nickel-cobalt alloy. The thickness of the heat generating layer 1 is preferably selected larger than a surface skin depth σ (m) represented by the following equation and not exceeding 200 μm:

$$\sigma=503\times(\rho/f\mu)^{1/2}$$

wherein f is frequency (Hz) of the magnetizing circuit, μ is magnetic permeability and ρ is resistivity (Ωm).

Figure 11:
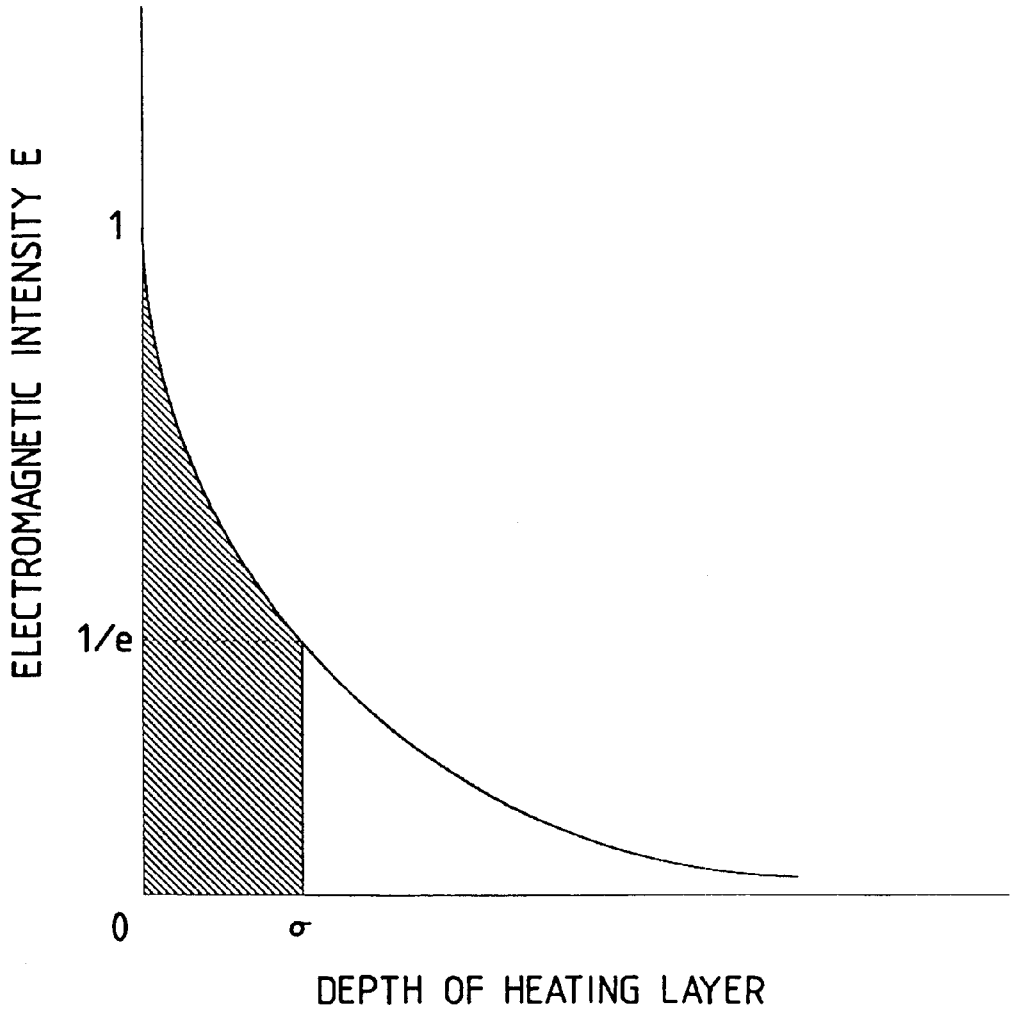
FIG. 11 is a chart showing the relationship between the depth of the heat generating layer and the intensity of the electromagnetic wave.

This equation indicates the depth of absorption of the electromagnetic wave used in the electromagnetic induction. As shown in FIG. 11, the intensity of the electromagnetic wave is less than 1/e in a deeper position. Stated differently, most of the energy is absorbed within the above-mentioned depth.

Preferably the heat generating layer 1 has a thickness within a range of 1 to 100 μm. If the heat generating layer is smaller than 1 μm, the efficiency deteriorates since it cannot absorb the significant portion of the electromagnetic energy. If the heat generating layer is larger than 100 μm, it becomes excessively rigid and poorly bendable to be used as a rotary member. Consequently, the thickness of the heat generating layer 1 is preferably within a range of 1 to 100 μm.

The elastic layer 2 is composed of a material with satisfactory heat resistance and thermal conductivity, such as silicone rubber, fluororubber or fluorosilicone rubber.

The elastic layer 2 preferably has a thickness of 10 to 500 μm, in order to ensure the quality of the fixed image.

In printing a color image, particularly a photographic image, there is often formed a solid image over a wide area on the recording member P. In such case, if the heating face (releasing layer 3) cannot intimately follow the surface irregularities of the recording member or the toner layer, there will result uneven heating, causing lustre unevenness in the parts of large amount of heat conduction and small amount of heat conduction (lustre is high when the amount of heat conduction is large and lustre is low when small). An elastic layer 2 thinner than 10 μm cannot follow the surface irregularities of the recording member or the toner layer, thereby generating uneven lustre in the image. On the other hand, an elastic layer 2 thicker than 1000 μm shows an excessively large heat resistance, so that the quick start of the device is difficult to achieve. More preferably the thickness of the elastic layer 2 is selected within a range from 50 to 500 μm.

Also, if the elastic layer 2 is excessively hard, it becomes unable to follow the surface irregularities of the recording member or the toner layer, thereby generating unevenness in the image lustre. It is therefore preferably provided with a hardness not exceeding 60° (JIS-A), more preferably not exceeding 45° (JIS-A).

The thermal conductivity λ of the elastic layer 2 is preferably selected within a range from $6\times10^{-4}$ to $2\times10^{-3}$ [cal/cm·sec·deg], because a thermal conductivity less than $6\times10^{-4}$ [cal/cm·sec·deg] leads to a high heat resistance, resulting in a slow temperature rising on the surface of the fixing film, while that larger than $2\times10^{-3}$ [cal/cm·sec·deg] leads to an excessively high hardness or a deteriorated permanent compression strain. For these reasons, the thermal conductivity is selected within the above-mentioned range, more preferably within a range from $8\times10^{-4}$ to $1.5\times10^{-3}$ [cal/cm·sec·deg].

The releasing layer 3 is composed of a material with satisfactory releasing performance and heat resistance, such as fluororesin (PFA, PTFE, FEP etc.), silicone resin, fluorosilicone rubber, fluororubber or silicone rubber.

The releasing layer 3 preferably has a thickness within a range of 1 to 100 μm. A thickness less than 1 μm leads to drawbacks of locally insufficient releasing property or durability because of unevenness in the coated film, while a thickness exceeding 100 μm leads to insufficient thermal conductivity, and, particularly in case of resinous releasing layer, becomes excessively hard, thus making no effect by the elastic layer 2.

Figure 4:
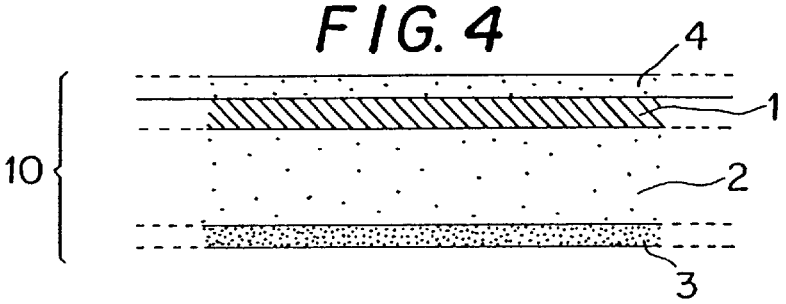
FIG. 4 is a cross-sectional view of a variation of the fixing film in the first embodiment.

In a layer structure of the fixing film 10, there may be provided a heat insulation layer 4 as shown in FIG. 4. The heat insulation layer 4 is preferably composed of heat-resistant resin such as fluororesin, polyimide resin, polyamide resin, polyamid-imide resin, PEEK resin, PES resin, PPS resin, PFA resin, PTFE resin or FEP resin. Also, the heat insulation layer 4 preferably has a thickness within a range from 10 to 1000 μm, since a film thinner than 10 μm cannot provide the heat insulating effect and results in deficient durability, while a film thicker than 1000 μm increases the distance from the high-permeability core 17 to the heat generating layer 1, so that the magnetic flux cannot be sufficiently absorbed therein.

If the heat insulation layer 4 is provided, the heat generated in the heat generating layer 1 can be insulated not so as to conduct to inner side of the fixing film, so that the heat supply to the recording member P can be improved in comparison with that having no heat insulation layer, thereby suppressing the electric power consumption.

(4) Pressure roller:

The pressure roller 30 is composed of a metal core, covered for example with silicone rubber or fluororubber, and is driven by an unrepresented driving mechanism.

In the present embodiment, as explained in the foregoing, at least a part of the magnetizing coil is provided along the fixing film not along the core, thus improving the heat efficiency while suppressing the temperature rise in the core, so that an image heating device capable of realizing quick start can be provided while maintaining high image quality, without formation of unevenness of lustre of the image.

In the present embodiment, the magnetizing coil is provided substantially entirely along the fixing film (film guide), but it is only required that at least a part of the magnetizing coil is provided along the fixing film, and the remaining part may be wound around the core.

However, with respect to the moving direction of the fixing film, in order to heat the fixing film in advance at the upstream side of the nip, it is preferable that the magnetizing coil is, at least in the upstream side of the nip, substantially entirely provided along the fixing film.

Also, in the present embodiment, the magnetizing coil is provided continuously over the entire width perpendicular to the moving direction of the fixing film, thereby generating uniform magnetic flux in the direction of width of the fixing film (namely longitudinal direction of the magnetizing coil) and thus realizing a uniform distribution in the heat generation.

Also, since the magnetizing coil is provided substantially linearly in the longitudinal direction thereof, the elongation of the film by thermal expansion in the nip portion occurs only in the film moving direction and in the perpendicular direction, thus no elongation occurs in a direction in which the film twists. For this reason, the present embodiment is almost free from the film twisting caused by thermal expansion and can therefore provide excellent durability.

In the present embodiment, the wires of the magnetizing coil 18 are arranged in a single layer, but they may be arranged in two or more layers.

Also, the heat generating layer of the present embodiment may be composed, instead of a metal substrate, of a resin layer containing metallic filler formed on a resinous film with sufficient heat resistance and mechanical strength, such as a polyimide film.

Figure 9:
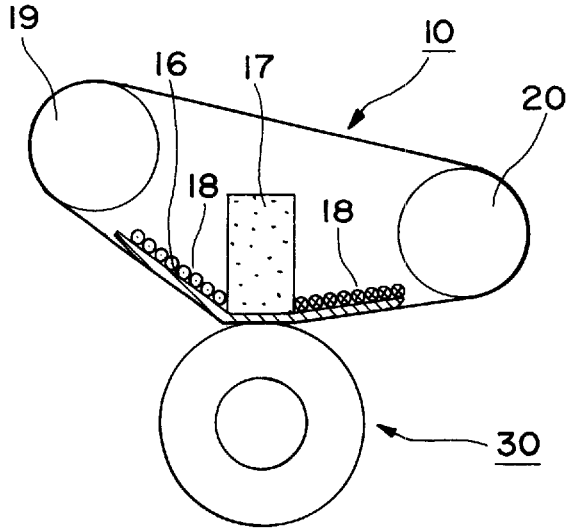
FIG. 9 is a cross-sectional view of a variation of the image heating device in the first embodiment.

Also, the fixing film in the present embodiment is driven by the pressure roller, but it is furthermore possible to apply a tension to the film by a tension roller 20 and to drive the film with a drive roller 19 as shown in FIG. 9. Also, there may be employed the film with a take-up mechanism.

Also, in the present embodiment, the heat fixing device is provided with no mechanism for oil application for preventing the offset phenomenon because the toner T contains a low-temperature softening substance, but such oil applying mechanism may be provided if the toner does not contain such low-temperature softening substance. Also, a cooling area may be provided after the fixing nip, in order to effect separation by cooling. Furthermore, such oil application or separation by cooling may be employed even when the toner contains the low-temperature softening substance.

The present embodiment has been explained by a four-color image forming apparatus, but it is applicable also to a monochromatic image forming apparatus of a one-pass multi-color image forming apparatus. In such case the elastic layer 2 may be dispensed with in the fixing film 10.

[Second Embodiment]

Figure 5:
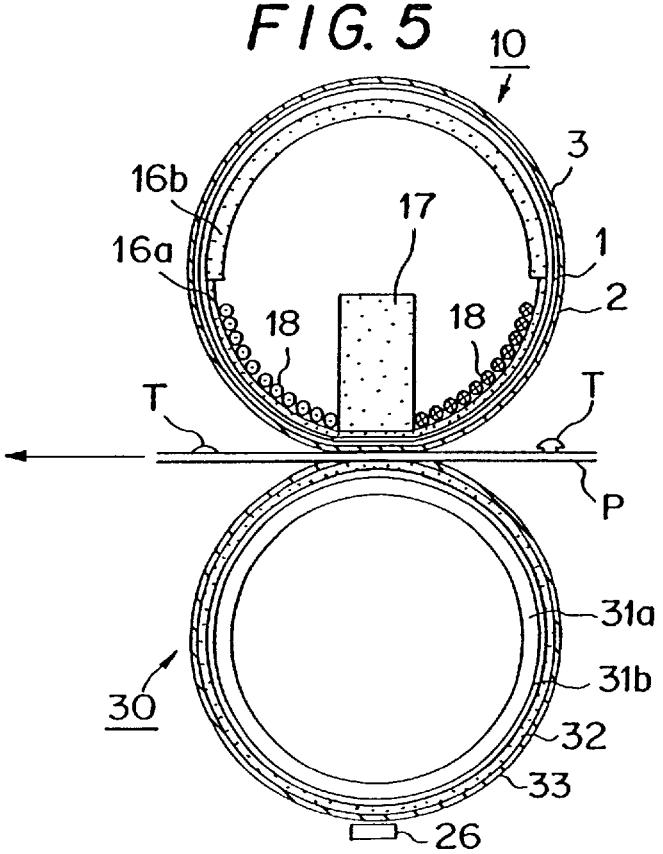
FIG. 5 is a cross-sectional view of an image heating device of a second embodiment.

In this embodiment, the pressure roller 30 in the fixing device of the first embodiment is replaced by such structure shown in FIG. 5 that an electroconductive heat generating layer 31*b* is provided on a metal core 31*a* composed for example of aluminum, further an elastic layer 32 and a releasing layer 33 are provided thereon in succession. The heat generating layer 31*b* may be composed of a non-magnetic metal, but is preferably composed of a ferromagnetic metal showing good absorption of the magnetic flux, such as nickel, iron, magnetic stainless steel or cobalt-nickel alloy.

Figure 6:
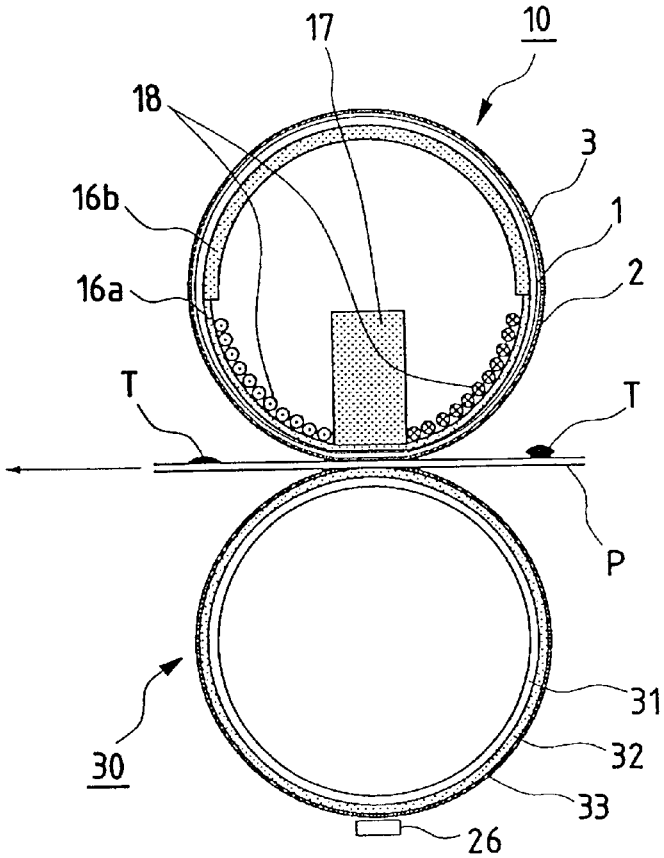
FIG. 6 is a cross-sectional view of a variation of the image heating device of the second embodiment.

Also, in the structure of the pressure roller 30, the metal core 31*a* and the heat generating layer 31*b* may be united, as shown in FIG. 6, into a rigid heat generating layer 31. Such structure where the heat generating layer serves also as the metal core can reduce the heat loss, thereby further improving the heat efficiency and decreasing the energy consumption.

The elastic layer 32 is composed of a material with satisfactory heat resistance and satisfactory thermal conductivity, such as silicone rubber, fluororubber or fluorosilicone rubber. The releasing layer 33 is composed of a material with satisfactory releasing property and satisfactory heat resistance, such as fluororesin (PFA, PTFE, FEP etc.), silicone resin, fluorinated silicone rubber, fluorinated rubber or silicone rubber.

Also, in the present embodiment the thickness of the fixing film 10 does not preferably exceed the surface skin depth σ(m) represented by the following formula, since the energy supplied to the heat generating layer of the pressure roller becomes small when beyond this depth:

$$\sigma=503\times(\rho/f\mu t)^{1/2}$$

where f is frequency (Hz) of the magnetizing circuit, $\mu$ is magnetic permeability and ρ is resistivity (Ωcm).

This equation indicates the depth of absorption of the electromagnetic wave used in the electromagnetic induction. Beyond this depth, the intensity of the electromagnetic wave does not exceed 1/e, so that most of the energy is absorbed up to this depth.

It is further preferable that a sum of the thickness of the conductive layer of the fixing film and the thickness of the conductive layer of the pressure roller is larger than the surface skin depth and that the thickness of the fixing film does not exceed the surface skin depth. These requirements can be understood from the above-mentioned properties of the absorption of the electromagnetic wave. The actual thickness of the fixing film and the thickness of the heat generating layer of the pressure roller are determined from the frequency of the magnetizing circuit and the resistance and the magnetic permeability of the conductive layer to be used, once necessary heat amount is determined. In this case, the heat generating layers of the fixing film and of the pressure roller need not be composed of a same material.

The above-explained structure of the pressure roller of the present embodiment is suitable for a device with a medium or high process speed (equal to or higher than 50 mm/sec). In such medium/high speed device, the recording member P cannot be heated sufficiently because of the short passing time thereof through the fixing nip N. Particularly, in a color image recording apparatus, there can be overlaid four toner layers at maximum, and defective fixing may occur because the recording member passes the fixing nip before the heat is sufficiently transmitted to the interface between the recording member and the toner layers.

For this reason, the presence of a conductive layer in the pressure roller as in the present embodiment allows to replenish the necessary heat for fixing, from the rear side of the recording member, by the heat generation in the pressure roller, thereby achieving a higher process speed.

[Third Embodiment]

Figure 7:
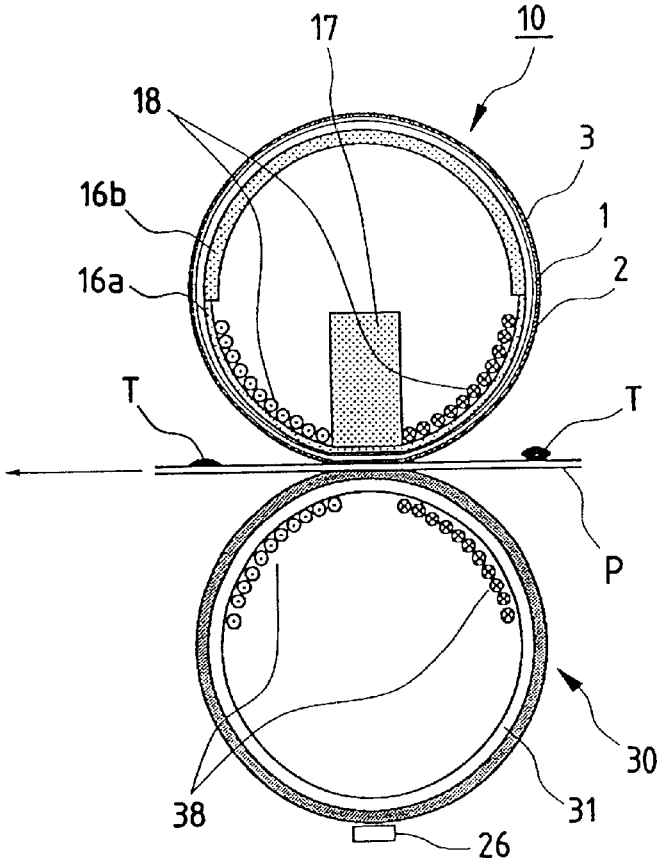
FIG. 7 is a cross-sectional view of an image heating device of a third embodiment.

In this embodiment, the pressure roller in the fixing device of the second embodiment is further provided therein with a magnetizing coil 38 as shown in FIG. 7. The pressure roller 30 includes a heat generating layer (metal core) as electroconductive layer. The pressure roller 30 is directly heated by an eddy current induced by the magnetic field generated by the magnetizing coil 38 in the metal core 31 of the pressure roller 30.

In order that the magnetic field generated by the magnetizing coil 38 is efficiently absorbed in the metal core 31, the distance between the magnetizing coil 38 and the metal core 31 is preferably as small as possible.

For this reason, the magnetizing coil 38 is constructed in arcuate shape along the curved surface of the metal core 31 as shown in FIG. 7 in order to increase the area where the metal core 31 and the magnetizing coil 38 are close each other. The distance between the metal core 31 and the magnetizing coil 38 is selected as about 1 mm. The arrangement of the magnetizing coil 38 as shown in FIG. 7 allows to increase the area where the magnetizing coil 38 faces closely the metal core 31.

The thickness of the metal core 31 should preferably not exceed 3 mm, since a thickness exceeding 3 mm increases the heat capacity and deteriorates the thermal response.

The distance between the metal core 31 and the magnetizing coil 38 is preferably as small as possible for achieving a higher absorbing efficiency for the magnetic flux, and the distance is selected in practice as 5 mm or less, since the absorbing efficiency is deteriorated if the above-mentioned distance exceeds 5 mm. On the other hand, if within the limit of 5 mm, the distance between the metal core 31 and the magnetizing coil 38 need not be constant.

As explained in the foregoing, in the present embodiment, the heating power can increase because of the presence of the magnetizing coil also in the pressure roller.

In the present embodiment, the magnetizing coil 38 is serially connected with the magnetizing coil 18 at the side of the fixing film, and the ratio of inductances at the sides of the fixing film and the pressure roller can be optionally selected by a change in the ratio of numbers of turns of the magnetizing coils 18 and 38, or a change in the frequency, or a change in the distance between the heat generating layer and the magnetizing coil. Thus there can be optionally selected the ratio of heat generation in the fixing film and in the pressure roller.

It is thus rendered possible to prevent the temperature descent in the pressure roller, in a continuous printing operation.

In FIG. 7, the magnetizing coil 38 has no core, but there may also be provided a core. The presence of a core increases the density of the magnetic flux for a given number of turns of the magnetizing coil, thereby providing a larger amount of heat.

[Fourth Embodiment]

Figure 8:
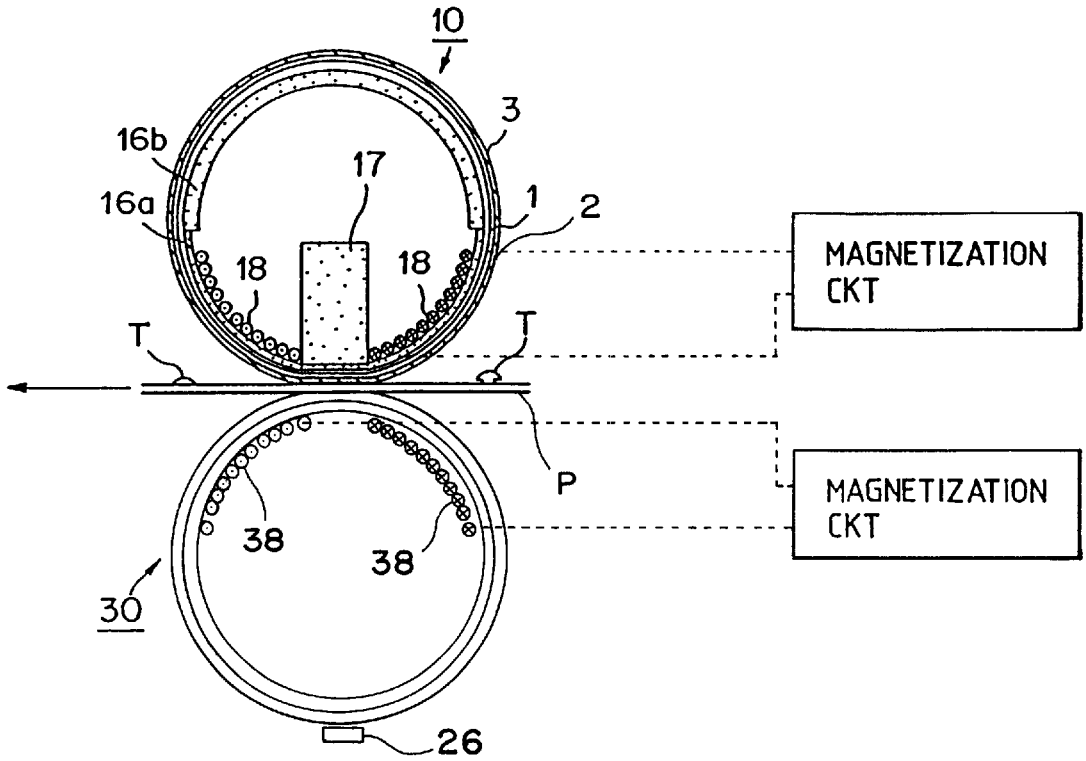
FIG. 8 is a cross-sectional view of an image heating device of a fourth embodiment.

In this embodiment, the magnetizing coils 18 and 38 in the fixing device of the third embodiment are respectively provided, as shown in FIG. 8, with magnetizing circuits. Consequently the amounts of heat generated in the fixing film 10 and in the pressure roller 30 can be independently controlled.

With such independent control of the heat generation of the fixing film 10 and the pressure roller 30, it is rendered possible, for example, to improve the image fixing property on a thick recording member, by increasing the heat generation in the pressure roller thereby supplying sufficient heat thereto. It is also possible to achieve the fixing operation in more stable manner in a continuous printing operation, by compensating the difference in the temperature descents in the fixing film and in the pressure roller, resulting from the difference in the heat capacity thereof.

The present invention has been explained by the preferred embodiments thereof, but it is not limited to such embodiments and is subject to various modifications within the scope and spirit of the appended claims.

What is claimed is:

1. A cylindrical endless film forming a loop and provided with a magnetic flux generator inside of the loop of said cylindrical endless film, said cylindrical endless film comprising:

a cylindrical electroconductive layer;

an elastic layer provided outside of said cylindrical electroconductive layer; and a releasing layer provided outside of said elastic layer.

2. An endless film according to claim 1, wherein said elastic layer and said releasing layer are successively formed on said electroconductive layer in order thereof.

3. An endless film according to claim 1, wherein said electroconductive layer is located at the most inner side of said film and said releasing layer is located at the most outer side of said film.

4. An endless film according to claim 1, wherein said electroconductive layer is a metal layer.

5. An endless film according to claim 1, wherein a thickness of said electroconductive layer is within a range of 1 to 100 $\mu$m.

6. An endless film according to claim 1, wherein said elastic layer is a rubber layer.

7. An endless film according to claim 1, wherein a thickness of said elastic layer is within a range of 10 to 500 $\mu$m.

8. An endless film according to claim 1, wherein said releasing layer is a resin layer.

9. An endless film according to claim 1, wherein said film includes a resin layer provided inside of said electroconductive layer.

10. A cylindrical endless film forming a loop and provided with a magnetic flux generator inside of the loop of said cylindrical endless film, said cylindrical endless film comprising:

cylindrical electroconductive layer; and an elastic layer provided outside of said cylindrical electroconductive layer.

11. An endless film according to claim 10, wherein said elastic layer is formed on said electroconductive layer.

12. An endless film according to claim 10, wherein said electroconductive layer is a metal layer.

13. An endless film according to claim 10, wherein a thickness of said electroconductive layer is within a range of 1 to 100 $\mu$m.

14. An endless film according to claim 10, wherein said elastic layer is a rubber layer.

15. An endless film according to claim 10, wherein a thickness of said elastic layer is within a range of 10 to 500 $\mu$m.

* * * * *

UNITED STATES PATENT AND TRADEMARK OFFICE

CERTIFICATE OF CORRECTION

PATENT NO. : 6,383,628 B2
DATED : May 7, 2002
INVENTOR(S) : Atsuyoshi Abe et al.

It is certified that error appears in the above-identified patent and that said Letters Patent is hereby corrected as shown below:

Column 3,
Line 3, "(FIG." should read -- (FIG. 1): --.

Column 7,
Line 9, "induca-" should read -- induc- --.
Line 59, "close" should read -- close to --.

Column 8,
Line 32, "Consequently" should read -- Consequently, --.

Signed and Sealed this

Fifteenth Day of April, 2003

JAMES E. ROGAN
*Director of the United States Patent and Trademark Office*